United States Patent [19]

Gunnergaard

[11] 4,008,748

[45] Feb. 22, 1977

[54] METHOD OF INSERTING CORES IN A SAND MOLD

[75] Inventor: Marius Gunnergaard, Lyngby, Denmark

[73] Assignee: Dansk Industri Syndikat A/S, Herley, Denmark

[22] Filed: Oct. 20, 1975

[21] Appl. No.: 623,995

[30] Foreign Application Priority Data

Oct. 23, 1974 Denmark ..... 5554/74

[52] U.S. Cl. ..... 164/30; 164/137; 164/340

[51] Int. Cl.[2] ..... B22C 9/10

[58] Field of Search ..... 164/30, 31, 32, 137, 164/340, 365, 366, 367, 368, 369, 370

[56] References Cited

UNITED STATES PATENTS

| | | | |
|---|---|---|---|
| 363,138 | 5/1887 | Herman | 164/340 X |
| 1,630,357 | 5/1927 | Pfeil | 164/365 |
| 1,657,444 | 1/1928 | Prince | 164/30 |
| 1,804,400 | 5/1931 | Davis | 164/31 |

*Primary Examiner*—John E. Roethel
*Attorney, Agent, or Firm*—Fleit & Jacobson

[57] ABSTRACT

A method of inserting a core in a sand mold wherein the sand mold is provided with a cavity for receiving the core, and, during the insertion of the core in the cavity, the sand around the core is compressed by an element or, if the core print is provided with a retaining projection, a further projection on the core print is provided for compressing the sand around the cavity in the sand mold which receives the retaining projection.

8 Claims, 2 Drawing Figures

METHOD OF INSERTING CORES IN A SAND MOLD

Figure 1:
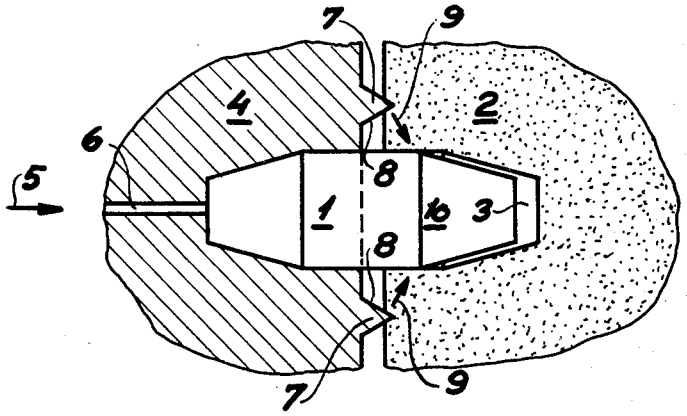

This invention relates to a method of inserting in a sand mould one or more cores provided with one or more prints for engagement in corresponding cavities in the mould.

When casting in moulds with horizontal joint faces the cores are inserted in the lower half of the mould, whereupon the upper half is fitted. In this case there is no risk of the core or cores dropping out during the positioning of the upper mould section on the lower section, but in the joining procedure the cores may be pushed or shaken slightly out of the proper position.

When casting in moulds with a vertical joint face the core or cores are inserted in the mould cavity of a vertical surface, frequently in a manner so that the point of gravity of a core is located in or outside the joint face. In that case the core is but feebly retained during the joining of the mould sections and there is a considerable risk of its falling out or being displaced in the joining procedure.

It is the object of the present invention to provide a method of the aforesaid type in which the said risk has been eliminated or at any rate highly reduced by the core or cores being retained effectively in one of the mould sections.

This object has been accomplished by a method which comprises a compression of the sand in one mould section in one or more regions adjacent to, preferably around at least one of the said cavities by means of one or more elements which are pressed into and produce recesses in the sand mould during the insertion of the core. The compression of the sand by the element adjacent to or around a cavity adapted to receive a core print causes the sand to be squeezed together against or around the said core print so as to increase the frictional force by which the core is retained in the mould section, and the risk of drop out or displacement during the positioning of the second mould section has been substantially reduced.

The said method is of course particularly advantageous where the employed moulds have vertical joint faces, but it is also useful where the joint face is inclined and even where the joint face is horizontal, for irrespective of the position of the joint face this method involves an improved fixation of the core or cores in the mould section.

Where a core mask is employed for positioning the core or cores in one of the mould sections the automatic production of the recess or recesses may expediently be carried out by means of one or more projections on the core mask disposed adjacent to, preferably around at least one print on the core inserted in the core mask or on at least one of the cores inserted in the core mask.

It is known to improve the retention of the cores in a mould section by providing the core prints with specific retaining projections and the mould section with cavities for receiving those projections. Where at least one core print is provided with one or more retaining projections for engagement in corresponding cavities in one or in both mould sections one or more sand-compressing recesses can be produced automatically adjacent to or around such retaining projection by providing at least one of the core prints having retaining projections with one or more further projections adjacent to, preferably around at least one retaining projection for producing the recess or recesses. Thus the said retaining projection and thereby the core will be retained still more effectively in the mould section.

By using projections with an inclined surface facing the said cavity it will be further ensured that the compression of the sand in the mould section effected by the introduction of the projection therein will be directed towards the said cavity and thus increase the contact pressure between the sand mould and the core print or its retaining projection.

Figure 2:
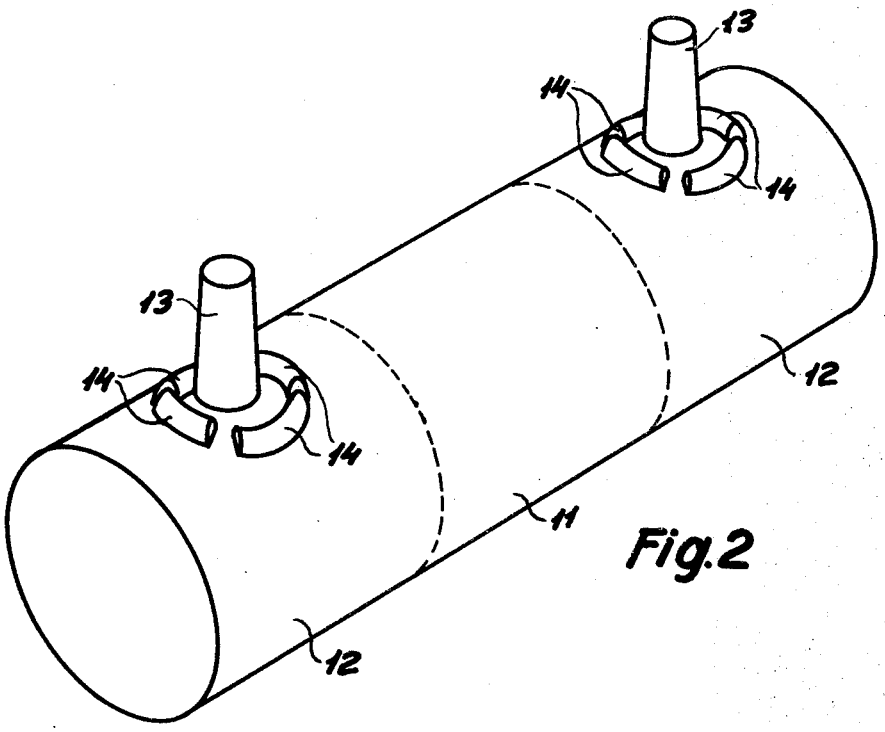

The invention will be described in greater detail below with reference to the drawing, in which FIG. 1 presents a vertical section through a core retained in a core mask during insertion in the sand mould in an embodiment of the method according to the invention, and FIG. 2 is a perspective view of a core with holding projections on the prints for carrying out another embodiment of the method according to the invention.

FIG. 1 shows a sand core 1 formed as a cylindrical stud with tapered end section. This core is to be inserted in a sand mould 2 provided with a cavity 3 for receiving the core print 10, which also has a tapered end section, whereby the risk of damage to the edges during insertion is reduced. The transition between the core 1 and its print 10 is indicated by a dotted line. For the insertion is used a core mask 4 in which the core is placed in a cavity of shape and dimensions corresponding to those of the core and which during the insertion procedure is moved in the direction indicated by the arrow 5. A channel 6 opening in the bottom of the cavity of the core mask enables the supply of vacuum to the cavity during the transport of the core to retain the core by suction and the supply of compressed air to the cavity when the core has been positioned in the mould 2 to detach the core from the core mask.

The core mask is further provided with an annular projection 7 which encloses the cavity and the core 1 positioned therein and which projects from the mask front facing the sand mould 2.

In the embodiment shown in the drawing the said projection 7 is of triangular cross section and has an inwardly inclined surface 8 which on the penetration of the projection into the mould causes the sand to be compressed in the directions indicated by the arrows 9, viz. around the core 1 which is being positioned in the space 3. This compression of the sand results in an increase of the contact pressure between the print of the core 1 and the walls of the cavity 3, whereby also the frictional force by which the core is retained in the mould is increased. The outwardly facing surface of the projection 7 need not be inclined as indicated but may, if desired, be substantially perpendicular to the front face of the core mask.

FIG. 2 shows a cylindrical sand core 11 provided at both ends with a cylindrical print 12 which form extensions of the core. The transitions between the core and the prints are indicated by dotted lines. On each print 12 is provided a conical retaining pin 13 adapted to be engaged in a corresponding recess in the sand mould to contribute to retaining the core in the mould, which is particularly advantageous where the partition surface of the sand mould is vertical.

Each print is further provided with four arcuate projections 14 arranged in a ring around the retaining pin 13. Like the annular projection 7 of the core mask shown in FIG. 1 these projections are adapted to compress the sand in the mould arond the retaining pin 13 during the insertion of the core in the mould. In the illustrated embodiment the projections are of substantially triangular cross-section, though, on account of the character of the material, with rounded ridge. The inner surfaces facing the pin should be inclined relatively to the pin axis.

The compression of the mould sand aimed at by the invention may be attained by means of many other types of projections than those shown in the drawing and described above. A core like that of FIG. 2 may have retaining projections in the form of peripheral collars instead of the pins shown in the drawing, and the compression projections may then be formed as banks extending along and spaced from the retaining collar on both sides thereof. The banks may form continuous rings or collars or they may be divided into a plurality of banks spaced in extension of each other in the same manner as the projections 14 shown in FIG. 2.

What we claim:

1. A method of inserting a core having a print in a sand mold provided with a cavity corresponding to the print comprising the steps of inserting the core in the cavity of the sand mold and compressing the sand of the sand mold with an element which produces a recess in a region adjacent to the cavity during said core inserting step.

2. A method according to claim 1 wherein said compressing step is carried out in a region surrounding said cavity.

3. A method according to claim 1 including the steps of positioning the core on a core mask having a projection adjacent to the print of the core in said mask and wherein said inserting step is carried out with the core positioned in said core mask and wherein said compressing step is performed by said projection on said mask with said projection producing said recess.

4. A method according to claim 3 wherein said projection in disposed in surrounding relationship with the print on the core inserted in said core mask.

5. A method according to claim 3 wherein said projection is provided with an inclined surface facing the cavity.

6. A method according to claim 1 including the steps of providing a retaining projection and a further projection adjacent the retaining projection on the core print, engaging said retaining projection within a corresponding cavity in the sand mold during said inserting step and wherein said compressing step is performed by said further projection with said further projection producing said recess.

7. A method according to claim 6 wherein said further projection is disposed in surrounding relationship with said retaining projection.

8. A method according to claim 6 wherein said further projection is provided with an inclined surface facing the cavity.

* * * * *

UNITED STATES PATENT OFFICE

CERTIFICATE OF CORRECTION

PATENT NO. : 4,008,748

DATED : February 22, 1977

INVENTOR(S) : Marius Gunnergaard

It is certified that error appears in the above-identified patent and that said Letters Patent are hereby corrected as shown below:

Column 4, line 12, change "in" (first occurrence) to --is--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*